United States Patent [19]

Sakai et al.

[11] Patent Number: 4,601,848

[45] Date of Patent: Jul. 22, 1986

[54] RESISTOR COMPOSITIONS FOR PRODUCING A RESISTOR IN RESISTOR-INCORPORATED SPARK PLUGS

[75] Inventors: Masao Sakai, Kasugai; Makoto Sugimoto, Nagoya; Miyakazu Hashizume, Nagoya; Yutaka Tanaka, Nagoya; Yukihiko Ito, Seto, all of Japan

[73] Assignee: NGK Spark Plug Co., Ltd., Japan

[21] Appl. No.: 690,628

[22] Filed: Jan. 11, 1985

[30] Foreign Application Priority Data

Jan. 18, 1984 [JP] Japan ..... 59-7853
Jan. 18, 1984 [JP] Japan ..... 59-7854

[51] Int. Cl.[4] ..... H01B 1/06

[52] U.S. Cl. ..... 252/503; 252/504; 252/506; 252/507; 252/508; 252/509; 252/510; 252/511

[58] Field of Search ..... 252/503, 504, 506, 507, 252/508, 509, 510, 511; 315/58; 313/144, 145, 136

[56] References Cited

U.S. PATENT DOCUMENTS

| | | | |
|---|---|---|---|
| 3,408,524 | 10/1968 | Blum et al. | 313/145 X |
| 3,525,894 | 8/1970 | Blum | 313/144 |
| 3,909,459 | 9/1975 | Freise et al. | 252/509 |
| 4,001,145 | 1/1977 | Sakai et al. | 252/516 |
| 4,006,106 | 2/1977 | Yoshida et al. | 252/516 |
| 4,173,731 | 11/1979 | Takagi et al. | 315/58 |
| 4,482,475 | 11/1984 | Sakai et al. | 252/507 |
| 4,504,411 | 3/1985 | Sakai et al. | 252/506 |

*Primary Examiner*—Josephine L. Barr
*Attorney, Agent, or Firm*—Larson and Taylor

[57] ABSTRACT

Resistor compositions for producing a resistor for use in resistor-incorporated spark plugs and comprising a glass, an inorganic aggregate, and carbon black and/or a carbonaceous substance as a regulating agent for resistance value, with or without a stabilizing agent for resistance under load of the resistor, are now modified by addition of a reducing metallic powder such as powder of Al, Mg, Zn, Sn, Ti, Zr, Fe, Ga and Ag or alloys thereof, to improve the service life characteristics under load of the resistor. Such compositions are further modified by additional presence of a ceramic aggregate of a particle size of 100 to 800 μm, to improve the electric wave noise-preventing property.

5 Claims, No Drawings

RESISTOR COMPOSITIONS FOR PRODUCING A RESISTOR IN RESISTOR-INCORPORATED SPARK PLUGS

SUMMARY OF THE INVENTION

This invention relates to new resistor compositions for producing a resistor in resistor-incorporated spark plugs. The new compositions according to this invention are able to produce a resistor which exhibits improved service life properties under load and improved properties for preventing the electric wave noise upon spark discharge.

BACKGROUND OF THE INVENTION

It is known that internal combustion engines are equipped with spark plugs and that the spark plugs may be of the type of resistor-incorporated spark plug wherein a spark plug is formed of a refractory insulator containing therein a center bore in which a sparking center electrode and a terminal electrode are inserted and sealed at both the ends of said bore, respectively, and which bore is filled with a resistor made of a resistor composition and sealed between the center electrode and the terminal electrode, the resistor being provided to attain a given resistance value for the purpose of preventing the occurrence of electric wave noise interferring the radio frequency wave upon ignition or spark discharge of the spark plug (see, for example, U.S. Pat. Nos. 4,173,731 and 4,482,475 specification). It is naturally desirable that the resistor should have a long and stable service life under discharge load as much as possible and should not be likely to deteriorate in its effect for prevention or suppression of the electric wave noise.

For the stabilization of the service life characteristics under load of the resistor composition for spark plug, for example, the electric aging method is known in which the resistor composition is electrically stabilized by application of high electric voltage. For this method, there was proposed a technique where a water-soluble carbonaceous substance is added into the resistor composition to prevent such reduction in the resistance value which is inevitably caused by the addition of carbon black (Japanese Patent Publication No. 22505/72). There was also proposed a technique where a resistor composition comprising glass/aggregate/carbon is incorporated with oxides and carbides of metals of groups IVa and Va etc. of Periodic Table (Japanese Patent Publication No. 19721/81), and so on. However, these days, spark discharge energy for spark plugs has been enhanced to meet a required high output of the engines. With known resistor compositions, the carbon present as one of the ingredients of the resistor compositions can be oxidized (burnt out) due to the enhanced current energy of the spark discharge running through the resistor in use, so that the resistor is likely to increase the resistance value during service. When a large amount of an agent for stabilizing the service life under load (such as $TiO_2$), namely an agent for stabilizing a change in the resistance value of the resistor with time during use (hereinafter abbreviated as stabilizing agent for the resistance) is added to the resistor composition to prevent such a phenomenon, the service life characteristics under load of the resistor can be improved, but reversely the temperature coefficient of the resistance value is deteriorated whereby the electric wave noise-preventing characteristics are deteriorated. On the other hand, Japanese Patent Publication Nos. 51142/81 and 60761/82 describe such self-sealing glassy resistor compositions which consist of glass-metal oxide and carbide (the stabilizing agent for the resistance under load)-carbon-metallic powder or alloy powder. However, these self-sealing glassy resistor compositions do not contain any aggregate or ceramic powder, and hence they show poor stabilization of the resistance value and a low effect for prevention of the electric wave noise, and therefore they cannot provide such resistor composition which is satisfiable sufficiently to cope with the increased spark discharge energy involved by the today's engines of the high output.

Further, Japanese patent application first publications "Kokai" No. 144830/75, No. 68131/74 (corresponding to DT-OS 2245404) and No. 105988/82 describe some examples of such spark plugs in which a resistor is incorporated in an insulator within spark plug to prevent the interference on communication electric wave as invoked at the time of the radio frequency waves being emitted from the high voltage ignition circuit of internal combustion engines.

In the resistor composition according to Japanese patent application first publication "Kokai" No. 144830/75, a ceramic filler (i.e. aggregate) having a relatively large particle size is used, while a glassy aggregate is used in the resistor compositions according to the above-mentioned two Japanese patent application first publication Nos. 68131/74 and 105988/82. In accordance with the invention of the Japanese patent application first application "Kokai" No. 105988/82, a glassy aggregate made of a glass of lithium/calcium boro-silicate base and having a relatively large particle size (all particles passing through 16 mesh) is used and is mixed with carbon black, a glass powder and an electrically insulating ceramic aggregate powder. Such glassy aggregates having the relatively large particle sizes can provide such resistor of te type that the internal structure has been blocked and the passages for electric current are zigzaged and so elongated, whereby the electric wave noise-preventing characteristics of the resistor are improved. In this resistor, however, the passages for the electric current are narrowed so that the density of the discharge current passing through said passages is increased, resulting in that the carbonaceous substances such as carbon present in the conventional resistor composition can be oxidized (burnt out) during service, rendering the resistance value to increase unduly. Moreover, the performances of the known resistor compositions become insufficient, as the spark discharge energy has been enhanced in the recent years to meet the high outputting of engines.

One object of the invention is to provide an improved resistor composition for resistor-incorporated spark plug, which exhibits a sufficiently stabilized service life under load to cope with the increased spark discharge energy involved by high outputting of today's engines.

Another object of the invention is to provide an improved resistor composition for resistor-incorporated spark plug, which exhibits a sufficiently stabilized service life under load as well as an enhanced effect of preventing the electric wave noise to cope with the increased spark discharge energy as produced by the high outputting of today's engines.

DETAILED DESCRIPTION OF INVENTION

According to a first aspect of this invention, there is provided a resistor composition for producing a resistor in resistor-incorporated spark plugs, which composition comprises (a) 100 parts by weight of a base mixture composed of 30 to 70% by weight of a glass and the balance being an inorganic aggregate, (b) 0 to 30 parts by weight of a stabilizing agent for the resistance under load, (c) 0.1 to 10 parts by weight of a regulating agent for the resistance value and comprising carbon black or an organic carbonaceous substance or a mixture of carbon black with an organic carbonaceous substance, and (d) 0.01 to 10 parts by weight of a metallic powder comprising one or more of the metals of Al, Mg, Zn, Sn, Ti, Zr, Fe, Ga and Ag and alloys of said metals.

The resistor composition for producing a resistor in resistor-incorporated spark plugs according to the first aspect of this invention as defined above is able to bring about such advantageous effects that the addition to said composition of the powder of such metal(s) having a relatively high reducing action prevents or suppresses such possible increase in the resistance value of the resistor which would be invoked by the oxidation (burning out) of the carbon content in the resistor-forming components owing to the enhanced spark discharge energy involved in the today's engines of high output, so that the resistance value of the resistor as made is stabilized well satisfactorily over a long period of time.

According to a second aspect of this invention, there is further provided a resistor composition for producing a resistor in resistor-incorporated spark plugs, which composition comprises:

(A) 10 to 70% by weight, based on the weight of said composition, of a resistance material being a mixture composed of (i) 2 to 60% by weight of a glass, (ii) 2 to 65% by weight of an inorganic aggregate, (iii) 0.1 to 7% by weight of a regulating agent for the resistance value and comprising one or more of carbon black and an organic carbonaceous substance and (iv) 0.01 to 10% by weight of a metallic powder comprising one or more of the metals of Al, Mg, Zn, Sn, Ti, Zr, Fe, Ag and Ga and alloys of said metals; the percentages by weight of the components (i) to (iv) being based on the whole weight of said resistor composition provided that the sum of the percentages of the components (i) to (iv) amounts to 10 to 70% of the whole weight of said resistor composition, and (B) 30 to 90% by weight, based on the weight of said composition, of a ceramic aggregate having particle size in a range of 100 μm to 800 μm;

The another, resistor composition for producing a resistor in resistor-incorporated spark plugs according to the second aspect of this invention as defined above is able to bring about such advantageous effects that the addition to said composition of the powder of such metal(s) having a relatively high reducing action prevents or suppresses such possible increase in the resistance value of the resistor which would be invoked by the oxidation (burning out) of the carbon content in the resistor-forming components owing to the enhanced spark discharge energy involved in the today's engines of high output, so that the resistance value of the resistor as made is stabilized well satisfactorily and also the required electric wave noise-preventing characteristics of the resistor are maintained satisfactorily over a long period of time.

The present invention of the first aspect will now be described in detail.

As a binder for the spark plug resistor is used in the composition of this invention a glass such as a boro-silicate base glass, a barium borate glass, a lead glass and the like. Particularly, glasses containing BaO exhibit an excellent property of wetting the carbonaceous substances and is preferred as the binder. Preferably, the softening point of the glass is higher than 300° C. If the softening point of the glass used is too low, it is difficult in the practical use of the resistor in engine to secure a tight bonding of the center electrode rod and terminal electrode rod in the plug and the resistance value of the resistor is likely to fluctuate, thereby causing many problems. The glass used as the binder in the invention may be prepared according to known process, and it is pulverized in the fine powdery form and fritted for use.

In the resistor composition of the first aspect of this invention, amongst the total inorganic components of the resistor composition, the base mixture (a) (the glass+inorganic aggregate) composes of 30–70% by weight of glass. When the proportion of the binder glass is less than 30% in the base mixture (a), the bonding of the aggregate is not sufficient so that the resistor becomes porous and so that not only the gas tightness and the service life characteristics under load of the resistor are deteriorated but also the forced insertion of the terminal electrode rod (of a male screw type) becomes difficult and further the bonding strength of the resistor to the wall surface of the central bore can be reduced.

On the other hand, if the proportion of the binder glass is more than 70% in the base mixture, the binder glass penetrates into the voids between the carbon particles acting as the electrically conductive material, rendering the resistance value of the resistor to be greatly increased and also rendering the fluctuation in the resistance value to be increased. Moreover, upon the hot-pressing of the resistor, the resistor body can fill the center bore of the plug insulator under compression without the end surfaces of the resistor body becoming at the angle right to the longitudinal axis of the center bore of the insulator, so that the resistor body is sealed with the upper and lower end surfaces of the resistor being sphered in the shape, with the consequences that the effective length of the resistor becomes shorter than the length of a given design value, it becomes difficult to obtain a desired resistance value, and that even the electric wave noise-preventing effect becomes inferior.

The available inorganic aggregate includes oxides and mineral silicates and the like which can usually be used as the raw materials for production of ceramics, and it may be, for example, alumina, zircon, mullite, fused silica, magnesia, silica, and clays. The inorganic aggregate may include crystalline or non-crystalline substances, and also may include heat-resistant powdery materials which are electrically poor conductive material. Preferably, the inorganic aggregate may contain, in addition to the above-mentioned materials, at least one of some nitrides such as silicon nitride, boron nitride and aluminium nitride.

The inorganic aggregate is added for the purpose to give a heat-resistant property to the resistor and to exert the action of preventing the end surfaces of resistor from becoming sphered. In particular, when the addition of more than 0.1% by weight of said nitrides is made, it serves to improve further the electric wave noise-preventing effect of the resistor.

As is known in the art, the resistor contains, for the purpose of regulating the resistance value thereof, a given amount of a carbonaceous substance (c) (such as carbon black, acetylene black, graphite, pitch powder or organic carbonaceous substance carbonizable during sintering), in addition to said base mixture (a). The carbonaceous substance is added in a proportion of 0.1–10% by weight (preferably 0.5–3% by weight) to 100 parts by weight of said base mixture, as calculated in terms of the carbon content. Generally, if the carbonaceous substance is present in a proportion of less than 0.1% by weight, the resistance value of the resistor increases excessively. While, if the proportion of the carbonaceous substance exceeds 10% by weight, the resistance value of the resistor reversely decreases so as to be ineffective for the prevention of the electric wave noise.

It is preferable that the organic carbonaceous substance carbonizable upon sintering is such one which can also act as a binder for the powdery resistor composition, and therefore known organic bonding substances may usually be employed therefor. For example, there can be used for this purpose any water-soluble organic bonding agents such as dextrin, carboxymethyl cellulose (CMC), methyl cellulose, glycerine, cane sugar, lactose, maltose, glucose, xylose and polyvinyl alcohol (PVA), as well as lubricating binders such as paraffin wax.

In the resistor compositions for resistor-incorporated spark plug according to the first aspect of the invention, it is preferable to use a stabilizer (the stabilizing agent for the resistance under load) for stabilizing the resistance life characteristics under load (i.e. for stabilizing a change in the resistance value with time during use) in a proportion of 0 to 30 parts by weight per 100 parts by weight of said base mixture. This stabilizer may be of the same substance as that of the stabilizer which is to be added to an electrically conductive sealing glass material as disclosed in Japanese patent application first publication "Kokai" No. 27983/75, and it has been confirmed by the present inventors in respect of the inventions of Japanese patent application first publication "Kokai" No. 27983/75 and No. 27984/75 that the same stabilization effect can be attained even when said stabilizer is added to the resistor itself.

However, it is desirable that the glass content in said base mixture is not less than 30% by weight of the total weight of the inorganic components of the resistor composition, even when the stabilizing agent for the resistance under load is incorporated.

The metal powder having a high reducing action and comprising one or more of Al, Mg, Zn, Sn, Ti, Zr, Fe, Ag and Ga or alloys of these metals is added in a proportion of 0.01 to 10 parts by weight per 100 parts by weight of said base mixture present in the resistor composition, for the purpose of preventing an increase in the resistance value which would be invoked due to that the carbon content in the composition could be oxidized (burnt out) by the electric current for the spark discharge flowing through the resistor. However, when the addition of the metallic powder is made in excess of 10 parts by weight, the resistance value of the resistor can be reduced excessively, thereby deteriorating the electric wave noise preventing effect.

The invention of the first aspect is now illustrated with reference to the following Examples.

Thus, several examples of the resistor composition according to the first aspect of this invention were prepared by blending a glass of the composition as indicated in Table 1 shown below, with the raw material additives comprising the aggregate, the stabilizing agent for the resistance under load, the metallic powder and the regulating agent for the resistance value as set out in Table 2 shown below, in the proportions as indicated in the Table 2, and then grinding and mixing uniformly the resulting blended mixture in a ball mill for 3 hours, so that several particular resistor compositions with the formulations as shown in Table 2 were formed. A spark plug sample was produced by inserting a central electrode into the lower end of the central bore in an insulator made of alumina, and charging into said central bore and on said central electrode 0.2 g of an electrically conductive sealing material, then 0.5 g of the ground and mixed formulation of the resistor composition prepared as above, subsequently a further 0.20 g of the electrically conductive sealing material and finally a terminal electrode at the upper end of the central bore. The whole insulator having the central bore charged with the above-mentioned materials was then heated at 850°–950° C. and a load pressure (40 Kg) was applied onto the charged materials in said central bore from the terminal electrode side so that the resistor composition formulation and the electrically conductive sealing materials filling the central bore were sintered and sealed by the hot-pressing. Onto the outer side of the insulator so processed was mounted a housing equipped with an earthing electrode, so that there was obtained a sample of the resistor-incorporated spark plug exhibiting a resistance value of 0.5–30 kilo-ohm which should be required for the prevention of the electric wave noise.

To test the stability of the service life under load of the resistor composition according to this invention, the following experiments were made. The spark plug sample was subjected to the sparking operation using a transistor-type ignition system for motorcar and under the conditions that the accumulation energy in the primary end of the ignition coil amounted to 100 miliJoule, the electric discharge voltage 30 kV and the discharge cycle 3600 cycles per minute. After 100 hours sparking operations, the rate (%) of change in the resistance value of the resistor was estimated (as an average for 10 samples). The results obtained are shown in Table 2 below.

TABLE 1

| | Glass composition | | | | | | |
|---|---|---|---|---|---|---|---|
| Glass | $SiO_2$ | $B_2O_3$ | $Al_2O_3$ | $Na_2O$ | PbO | ZnO | BaO |
| A | 36 | 25 | — | 7 | — | 18 | 14 |
| B | 11 | 45 | — | 8 | — | 36 | — |
| C | — | 65 | — | — | — | — | 35 |
| D | 29 | — | 4 | — | 67 | — | — |

TABLE 2

| | Glass of Table 1 | | Inorganic aggregate | | Regulating agent for resistance value | | Stabilizing agent for resistance under load | | Metallic powder | | Service life characteristic under load Change rate |
|---|---|---|---|---|---|---|---|---|---|---|---|
| Test No. | Grade | Proportion (parts by weight) | Nature | Proportion (parts by weight) | Nature | Proportion (parts by weight) | Nature | Proportion (parts by weight) | Nature | Proportion (parts by weight) | (%) of resistance value) |
| 1 | A | 50 | Silicon nitride | 50 | Methyl cellulose | 2.2 | | | Al | 0 | +75 |

TABLE 2-continued

| Test No. | Glass of Table 1 Grade | Glass of Table 1 Proportion (parts by weight) | Inorganic aggregate Nature | Inorganic aggregate Proportion (parts by weight) | Regulating agent for resistance value Nature | Regulating agent for resistance value Proportion (parts by weight) | Stabilizing agent for resistance under load Nature | Stabilizing agent for resistance under load Proportion (parts by weight) | Metallic powder Nature | Metallic powder Proportion (parts by weight) | Service life characteristic under load Change rate (%) of resistance value) |
|---|---|---|---|---|---|---|---|---|---|---|---|
| 2 | A | 50 | Silicon nitride | 50 | Methyl cellulose | 2.2 | | | Al | 0.01 | +23 |
| 3 | A | 50 | Silicon nitride | 50 | Methyl cellulose | 2.2 | | | Al | 1 | −4 |
| 4 | A | 50 | Silicon nitride | 50 | Methyl cellulose | 2.2 | | | Al | 10 | −28 |
| 5 | A | 50 | Silicon nitride | 50 | Methyl cellulose | 2.2 | | | Al | 12 | −35 |
| 6 | A | 50 | Silicon nitride | 50 | Methyl cellulose | 2.2 | | | Ga | 1 | −6 |
| 7 | A | 50 | Silicon nitride | 50 | Methyl cellulose | 2.2 | | | Zn | 1 | −10 |
| 8 | A | 50 | Silicon nitride | 50 | Methyl cellulose | 2.2 | | | Sn | 1 | −2 |
| 9 | A | 50 | Silicon nitride | 50 | Methyl cellulose | 2.2 | | | Ti | 1 | −5 |
| 10 | A | 50 | Silicon nitride | 50 | Methyl cellulose | 2.2 | | | Fe | 1 | ±0 |
| 11 | A | 50 | Silicon nitride | 50 | Methyl cellulose | 2.2 | | | Mg | 1 | −9 |
| 12 | A | 50 | Silicon nitride | 50 | Methyl cellulose | 2.2 | | | Ag | 1 | −5 |
| 13 | A | 50 | Silicon nitride | 50 | Methyl cellulose | 2.2 | | | Al<br>Zn | 0.5<br>0.5 | −5 |
| 14 | A | 50 | Silicon nitride | 50 | Methyl cellulose | 2.2 | | | Sn<br>Ti | 0.5<br>0.5 | −3 |
| 15 | A | 30 | Silicon nitride | 70 | Methyl cellulose | 2.2 | | | Al | 1 | +10 |
| 16 | A | 70 | Silicon nitride | 30 | Methyl cellulose | 2.2 | | | Al | 1 | −20 |
| 17 | A | 50 | Zircon | 50 | Methyl Cellulose | 2.2 | | | Al | 1 | −7 |
| 18 | A | 50 | Mullite | 50 | Methyl Cellulose | 2.2 | | | Al | 1 | −11 |
| 19 | A | 50 | Silicon nitride | 50 | Carbon black | 2.2 | | | Al | 1 | −13 |
| 20 | A | 50 | Silicon nitride | 50 | Methyl cellulose<br>Carbon black | 1.0<br>1.2 | | | Al | 1 | −7 |
| 21 | A | 50 | Silicon nitride | 50 | Methyl cellulose | 2.2 | $TiO_2$ | 10 | Al | 1 | −21 |
| 22 | B | 50 | Silicon nitride | 50 | Methyl cellulose | 2.2 | | | Al | 1 | −4 |
| 23 | C | 40 | Silicon nitride | 60 | Methyl cellulose | 2.2 | | | Al | 1 | −4 |
| 24 | D | 60 | Silicon nitride | 40 | Methyl cellulose | 2.2 | | | Al | 1 | −2 |
| 25 | A | 50 | Zircon<br>Clay | 25<br>25 | Methyl cellulose<br>Carbon black | 1.2<br>1.0 | | | | | +75 |
| 26 | A | 50 | Silicon nitride | 50 | Methyl cellulose | 2.2 | $TiO_2$ | 10 | | | +45 |

Test Nos, 1, 25 and 26 are "Comparative" experiments.

Now, the present invention of the second aspect will be described with reference to some examples of the resistor composition for producing the resistor in resistor-incorporated spark plug according to the second aspect invention.

The resistor composition for resistor-incorporated spark plug according to the second aspect of the invention may comprises:

(A) 10–70% by weight (based on the weight of said composition) of a resistance material being a mixture composed of (i) 2–60% by weight of a resistance material-forming glass such as glasses of $BaO-B_2O_3$ base, $BaO-B_2O_3-SiO_2$ base, $BaO-B_2O_3-SiO_2-R_2O$ (RO) base, $PbO-SiO_2$ base, $PbO-B_2O_3-SiO_2-Al_2O_3$ base, $B_2O_3-SiO_2$ base, $B_2O_3-SiO_2-Al_2O_3$ base, $B_2O_3-SiO_2-R_2O$ (RO) base, or $B_2O_3-SiO_2-Al_2O_3-R_2O$ (RO) base (where RO and $R_2O$ each denote $Na_2O$, $K_2O$, $Li_2O$, MgO, CaO or ZnO, and the like) and which glass shows a yielding point of 300° to 700° C. and has preferably a particle size of 150 μm, (ii) 2–65% by weight of an inorganic aggregate powder such as powder of zirconia, fused silica, alumina, bentonite, ball clay, silica, siliceous sand, feldspar, mullite, zircon, β-spondumene, silicon nitride, boron nitride, or aluminium nitride, which may preferably have a particle size of not more than 150 μm, (iii) 0.1–7% by weight of a regulating agent for the resistance value, which comprises one or more of carbon black and organic carbonaceous substances such as water-soluble carbonaceous substances, including sugars such as cane sugar, lactose, maltose, raffinose, glucose, xylose, dextrin and methyl cellulose, and aliphatic hydrocarbons such as ethylene glycol, glycerine, propylene glycol, polyethylene glycol, and polyvinyl alcohol; and (vi) 0.01–10% of a metallic powder comprising one or more of the metals of Al, Mg, Zn, Ti, Zr, Fe, Ag and Ga and alloys of said metals, which may desirably have a particle size of not more than 150 μm and preferably a particle size of not more than 60 μm; and (B) 30–90% by weight (based on the weight of the composition) of the balance being a ceramic aggregate which has a particle size in the range of 100–800 μm; the above-mentioned percentages by weight of all the ingredients of the resistor composition being calculated in term of the weight of said composition.

As the ceramic aggregate (B) having a particle size from 100 to 800 μm can be used a glass powder, a ceramic material powder, or particles made of a mixture of a glass powder and a ceramic material powder. Of the ceramic aggregate (B), the glassy aggregate may preferably be either a glass such as glasses of $B_2O_3$-$SiO_2$-$R_2O$ (RO) base, $B_2O_3$-$SiO_2$-$Al_2O_3$-$R_2O$ (RO) base, $B_2O_3$-$SiO_2$-$Al_2O_3$ base, $B_2O_3$-$SiO_2$ base, or $SiO_2$-$Al_2O_3$-$R_2O$ (RO) base (where $R_2O$ or RO denotes the same components as in said glass (i) for the resistance material (A)) which shows a relatively high melting point and a yielding point of 550°–900° C., or a crystallized glass. The ceramic material for the ceramic aggregate (B) may be such one which shows desirably a relatively high melting point, such as fused silica, fused alumina, silicon nitride, fused magnesia, or zircon. In the case when the particles made of the mixture of a glass powder and a ceramic material powder are used as the ceramic aggregate (B), there may be employed such particles which have been prepared by mixing a suitable amount of one of the various glasses such as said glasses for the resistance material (A) and in said glassy aggregate, with a proper amount of said ceramic material powder, and pre-calcining the resultant mixture to produce the particles having a particle size of 100–800 μm.

Depending on the particular composition of the resistor, if desired, a portion of the inorganic aggregate (ii) which is making the proportion of 2–65% by weight of the resistor composition of the second aspect invention may be replaced by the stabilizing agent for the resistance under load comprising one or more of the oxides and carbides of the metals and rare earth metals of Subgroups: IVa group, Va group and VIa group of the Periodic Table, as well as ZnO, $B_4C$, SiC, TiB and TiN, to such an extent that the stabilizing agent for the resistance under load which was used for said placement is amounting to a proportion of up to 30% by weight of the total weight of the ingredients of the resistor composition.

The reasons why the proportion of the stabilizing agent for the resistance under load which serves to stabilize the service life characteristics under load should be limited to the amount of up to 30% by weight mentioned just above are as follows: An addition of said stabilizing agent in excess of the 30% by weight can deteriorate the temperature coefficient of the resistance value of the resistor and also decrease the electric wave noise-preventing property.

The metallic powder (vi) of the aforesaid metals (Al, Mg and others) or alloys thereof serves as the component for stabilizing the resistance value which participates in the service life characteristics under load of the resistor. This stabilizing effect will be lost if the content of said metallic powder is less than the lower limit of 0.01% by weight, and then the resistance value will increase, making the resistor useless. If the metallic powder content exceeds the upper limit of 10% by weight, the resistance value decreases excessively, thereby deteriorating the electric wave noise-preventing effect.

The regulating agent (iii) for the resistance value as employed is electrically conductive, and the proportion of the regulating agent will regulate actual figure of the resistance value of 0.5–3.0 kΩ required for the necessary electric wave noise-preventing effect. Less than 0.1% by weight of the regulating agent can increase the resistance value excessively, while more than 7% by weight of the regulating agent can decrease the resistance value too much, so that in both the cases the resistor becomes useless.

The glass (i) for forming the resistance material (A) is essentially required as the bonding agent upon sintering and sealing of the resistor composition. When the glass content is below the lower limit of 2% by weight, the bonding power is too weak. If the glass content exceeds the upper limit of 60% by weight, the regulating agent for the resistance value will deteriorate in its dispersibility in the matrix so that resistance value of the resistor will greatly fluctuate. Poor sealing adversely affects the service life characteristics under load of the resistor. Further, more than 2% by weight of the inorganic aggregate (ii) is necessary to improve the dispersibility of the regulating agent (iii) for the resistance value. If the inorganic aggregate content exceeds the upper limit of 60% by weight in the composition, the resistor made therefrom will produce poor sintering and become porous in the texture to deteriorate the service life characteristics under load.

If the content of the resistance material (A) of the resistor composition is less than the lower limit of 10% in the total resistor, the passages for the electric current are narrowed, so that the flow of the electric current can be concentrated to local areas upon application of high voltage, rendering the resistance value to be increased. While, if the proportion of the resistance material exceeds the upper limit of 70% by weight, the effect of the insulating ceramic aggregate (B) added cannot be developed, deteriorating the electric wave noise-preventing property of the resistor profoundly.

In case the aforesaid mixture of a glass powder and a ceramic material powder is used as the ceramic aggregate (B), this mixture may preferably have been pre-calcined to effect pre-sintering of the mixture. This pre-calcination may be carried out either before or after the mixture is formed into the particles of a particle size in the range 100–800 μm. However, the particles previously made of the mixture of glass powder and ceramic material powder may not be pre-calcined, as these particles are subsequently subjected to the thermal action similarly to that of the aforesaid pre-calcining treatment, when the particles will undergo the hot-pressing operation for the sealing after the particles are mixed with the resistance material (A) comprising the glass, the inorganic aggregate powder, the stabilizing agent for the resistance under load, the regulating agent for the resistance value and the metallic powder.

By using the particles prepared as above from the mixture of a glass powder and a ceramic material powder for the ceramic aggregate (B) of the resistor composition of this invention, there is produced such resistor body where the resistance material (A) of the resistor composition has formed a continuous phase around every particles made of the glass powder/ceramic material powder mixture used for the ceramic aggregate (B). When a glass having even a low softening point is employed in said mixture, the apparent softening point of said whole mixture can be controlled somewhat optionally by selecting the value of the yielding point of the glass and also by choosing the ratio of the glass powder to the ceramic material powder mixed. Accordingly, the aforesaid mixture of glass powder and ceramic material powder may optionally choose a formulation which is just adaptable to a given sealing temperature of the resistor composition.

When the ceramic aggregate (B) comprising the particles made of the mixture of glass powder and ceramic material powder is employed, it is not preferred that the particle size of the glass powder and the ceramic material powder present therein is much more than 150 μm. Coarser particle size gives a non-uniform mixture, and the different particles present in the ceramic aggregate comprising such coarser particles show different softened states in the vicinity of a given sealing temperature, so that the configuration of the aggrefgate can be deformed and non-uniformly softened, thereby adversely affecting the electric wave noise-preventing property of the resistor.

Preferably, an organic binder may be used when the ceramic aggregate (B) is mixed with the resistance material (A) to form a composition. As the organic binder for the purpose is used a solution or an emulsion of dextrin, methyl cellulose, polyvinyl alcohol or gum arabic in water or organic solvent. Alternatively, the regulating agent for the resistance value itself may be utilized for said organic binder. When the ceramic aggregate (B) is mixed with the resistance material (A), uniform mixing of these ingredients will be assisted by adding the organic binder simultaneously or by premixing it with either one of the ceramic aggregate and the resistance material.

The particle size of the ceramic aggregate should be in the range of 100–800 μm in order to attain a maximum electric wave noise-preventing property of the resistor. If the particle size is outside said range, i.e., is more than and less than said particular range, the electric wave noise-preventing performance can be deteriorated. The resistance material consisting of the glass, the inorganic aggregate powder, the stabilizing agent for the resistance under load, the metallic powder and the regulating agent for resistance value need to be uniformly distributed and sealed around every particles of the ceramic aggregate, and it is desirable that the particle size of each of the above components of the resistance material is not more than 150 μm, and preferably not more than 100 μm.

The invention of the second aspect is now illustrated with reference to the following Examples.

Thus, several examples of the resistor composition according to the second aspect of this invention were prepared by blending a glass of the composition as indicated in Table 3 shown below, with a raw resistance material ingredients comprising the inorganic aggregate powder, the regulating agent for the resistance value and the metallic powder as set out in Table 4 shown below, in the proportions as indicated in Table 4, and then grinding and mixing uniformly the resulting blended mixture in a ball mill, and further blending the so ground mixture with the ceramic aggregate of a particle size of 100–800 μm as shown in Table 4, so that several particular resistor compositions with the formulations as shown in Table 4 were obtained. A spark plug sample was produced by inserting a central electrode into the lower end of the central bore in an insulator made of alumina, and charging into said central bore and on said central electrode 0.2 g of an electrically conductive sealing material, then 0.5 g of the ground and mixed formulation of the resistor composition prepared as above, subsequently a further 0.20 g of the electrically conductive sealing material and finally a terminal electrode at the upper end of the central bore. The whole insulator having the central bore charged with the above-mentioned materials was then heated at 800°–1000° C. and a load pressure (40 Kg) was applied onto the charged materials in said central bore from the terminal electrode side so that the resistor composition formulation and the electrically conductive sealing materials filling the central bore were sintered and sealed by the hot-pressing. Onto the outer side of the insulator so processed was mounted a housing equipped with an earthing electrode, so that there was obtained a sample of the resistor-incorporated spark plug exhibiting a resistance value of 0.5–30 kilo-ohm which should be required for the prevention of the electric wave noise.

To test the stability of the service life under load of the resistor composition according to the second aspect of this invention, the following experiments were made. The spark plug sample was subjected to the sparking operation using a transistor-type ignition system for motorcar and under the conditions that the accumulation energy in the primary end of the ignition coil amounted to 100 mili-Joule, the electric discharge voltage 30 kV and the discharge cycle 3600 cycles per minute. After 100 hours sparking operations, the rate (%) of change in the resistance value of the resistor was estimated (as an average for 10 samples). The results obtained are shown in Table 4 below.

TABLE 3

| | Glass composition | | | | | | | |
|---|---|---|---|---|---|---|---|---|
| Glass | $SiO_2$ | $B_2O_3$ | $Al_2O_3$ | $Na_2O$ | ZnO | BaO | CaO | PbO |
| A' | — | 65 | — | — | — | 35 | — | — |
| B' | 11 | 45 | — | 8 | 36 | — | — | — |
| C' | 29 | — | 4 | — | — | — | — | 67 |
| D' | 65 | 22 | 2 | 5 | — | — | 6 | — |
| E | 80 | 13 | 3 | 4 | — | — | — | — |

TABLE 4

| | Resistance Material (A) | | | | | | | | Ceramic aggregate (B) | | Service life characteristics under load |
|---|---|---|---|---|---|---|---|---|---|---|---|
| Test No. | Glass of Table 3 | Proportion (% by wt.) | Inorganic aggregate powder | Proportion (% by wt.) | Regulating agent for resistance value | Proportion (% by wt.) | metallic powder | Proportion (% by wt.) | Nature | Proportion (% by wt.) | Change rate (%) in resistance value |
| 1 | A' | 10 | Zirconia | 15 | Carbon black | 2 | Al | 0 | Glass D' of Table 3 | 73 | +150 |
| *a 2 | A' | 10 | " | 15 | " | 2 | Al | 0.01 | Glass D' | 72.99 | +22 |

TABLE 4-continued

| Test No. | Resistance Material (A) Glass of Table 3 | Proportion (% by wt.) | Inorganic aggregate powder | Proportion (% by wt.) | Regulating agent for resistance value | Proportion (% by wt.) | metallic powder | Proportion (% by wt.) | Ceramic aggregate (B) Nature | Proportion (% by wt.) | Service life characteristics under load Change rate (%) in resistance value |
|---|---|---|---|---|---|---|---|---|---|---|---|
| | | | | | | | | | of Table 3 | | |
| 3 | A' | 10 | " | 15 | " | 2 | Al | 1 | Glass D' of Table 3 | 72 | −5 |
| 4 | A' | 10 | " | 15 | " | 2 | Al | 10 | Glass D' of Table 3 | 63 | −28 |
| 5 | A' | 10 | " | 15 | " | 2 | Al | 12 | Glass D' of Table 3 | 61 | −34 |
| 6 | A' | 10 | " | 15 | " | 2 | Ga | 1 | Glass D' of Table 3 | 72 | −3 |
| 7 | A' | 10 | " | 15 | " | 2 | Zn | 1 | Glass D' of Table 3 | 72 | −6 |
| 8 | A' | 10 | " | 15 | " | 2 | Sn | 1 | Glass D' of Table 3 | 72 | −2 |
| 9 | A' | 10 | " | 15 | " | 2 | Ti | 1 | Glass D' of Table 3 | 72 | −6 |
| 10 | A' | 10 | " | 15 | " | 2 | Fe | 1 | Glass D' of Table 3 | 72 | −1 |
| 11 | A' | 10 | " | 15 | " | 2 | Mg | 1 | Glass D' of Table 3 | 72 | −8 |
| 12 | A' | 10 | " | 15 | " | 2 | Ag | 1 | Glass D' of Table 3 | 72 | −3 |
| 13 | A' | 10 | " | 15 | " | 2 | Al<br>Zn | 0.5<br>0.5 | Glass D' of Table 3 | 72 | −7 |
| 14 | A' | 10 | " | 15 | " | 2 | Sn<br>Ti | 0.5<br>0.5 | Glass D' of Table 3 | 72 | −7 |
| 15 | A' | 2 | " | 65 | " | 2 | Al | 1 | Glass D' of Table 3 | 30 | +4 |
| 16 | A' | 60 | " | 2 | " | 2 | Al | 1 | Glass D' of Table 3 | 30 | −19 |
| 17 | B' | 10 | " | 15 | " | 2 | Al | 1 | Glass D' of Table 3 | 72 | −5 |
| 18 | C' | 10 | " | 15 | " | 2 | Al | 1 | Glass D' of Table 3 | 72 | −6 |
| 19 | A' | 10 | Alumina | 15 | " | 2 | Al | 1 | Glass D' of Table 3 | 72 | −2 |
| 20 | A' | 10 | Silicon nitride | 15 | " | 2 | Al | 1 | Glass D' of Table 3 | 72 | −8 |
| 21 | A' | 10 | Zirconia | 15 | Methyl cellulose | 2 | Al | 1 | Glass D' of Table 3 | 72 | +11 |
| 22 | A' | 10 | " | 15 | Carbon black<br>Dextrin | 1<br>1 | Al | 1 | Glass D' of Table 3 | 72 | −3 |
| 23 | A' | 10 | " | 15 | Carbon black | 2 | Al | 1 | Glass E of Table 3 | 72 | −6 |
| 24 | A' | 10 | " | 15 | " | 2 | Al | 1 | Fused silica | 72 | −1 |
| 25 | A' | 10 | " | 15 | " | 2 | Al | 1 | A mixture (*b) of 50% Glass D' of Table 3 with 50% Alumina | 72 | −4 |
| 26 | A' | 10 | Zirconia<br>$TiO_2$ | 10<br>5 | Carbon black | 2 | Al | 1 | Glass D' of Table 3 | 72 | −13 |
| 27 | A' | 20 | Zirconia | 48 | " | 1 | Al | 1 | Glass D' of Table 3 | 30 | −18 |
| 28 | A' | 2 | " | 3 | " | 4 | Al | 1 | Glass D' of Table 3 | 90 | +12 |

In Table 4,
*a denotes a known resistor composition.
*b denotes that the mixture has been pre-calcined.

What we claim is:

1. A resistor composition for producing a resistor in resistor-incorporated spark plugs, which composition comprises (a) 100 parts by weight of a base mixture composed of 30 to 70% by weight of a glass and the balance being an inorganic aggregate; said inorganic aggregate being selected from the group consisting of alumina, zircon, mullite, silica, fused silica, magnesia, clay, silicon nitride, aluminium nitride and boron nitride, or a mixture of two or more thereof, (b) 0 to 30 parts by weight of a stabilizing agent for the resistance under load, said stabilizing agent for the resistance under load being selected from the group consisting of one or more of the oxides and carbides of rare earth elements and metals of Sub-groups: IVa group, Va group and VIa group of the Periodic Table, ZnO, $B_4C$, SiC, TiB and TiN, (c) 0.1 to 10 parts by weight of a regulating agent for the resistance value; said regulating agent being selected from the group consisting of carbon black, an organic carbonaceous substance and a mixture of carbon black with an organic carbonaceous substance, and (d) 0.01 to 10 parts by weight of a metallic powder being selected from the group consisting of one or more of the metals of Al, Mg, Zn, Sn, Ti, Zr, Fe, Ga and Ag and alloys of said metals.

2. A resistor composition for producing a resistor in resistor-incorporated spark plugs, which composition comprises:

(A) 10 to 70% by weight, based on the weight of said composition, of a resistance material being a mixture composed of (i) 2 to 60% by weight of a glass, (ii) 2 to 65% by weight of an inorganic aggregate; said inorganic aggregate being selected from the group consisting of alumina, zircon, mullite, silica, fused silica, magnesia, clay, silicon nitride, aluminium nitride and boron nitride, or a mixture of two or more thereof, (iii) 0.1 to 7% by weight of a regulating agent for the resistance value; said regulating agent being selected from the group consisting of one or more of carbon black and an organic carbonaceous substance and (iv) 0.01 to 10% by weight of a metallic powder being selected from the group consisting of one or more of the metals of Al, Mg, Zn, Sn, Ti, Zr, Fe, Ag and Ga and alloys of said metals; the percentages by weight of the components (i) to (iv) being based on the whole weight of said resistor composition, provided that the sum of the percentages of the components (i) to (iv) amounts to 10 to 70% by weight of the whole weight of said resistor composition; and (B) 30 to 90% by weight, based on the weight of said composition, of a ceramic aggregate having particle size in a range of 100 μm to 800 μm; said ceramic aggregate (B) being a glass of a yielding point of 550°-900° C., or a ceramic material which is selected from the group consisting of fused silica, fused alumina, mullite, fused magnesia, zircon and silicon nitride, of a pre-calcined product of a mixture of a glass powder with said ceramic material.

3. A composition as claimed in claim 2, wherein a portion of the inorganic aggregate (ii) which forms the part of 2 to 65% by weight of said composition is replaced by the stabilizing agent for the resistance under load to such an extent that the proportion of said stabilizing agent used for the replacement is up to 30% by weight of the total weight of the resistor composition; said stabilizing agent being selected from the group consisting of one or more of the oxides and carbides of metals and rare earth elements of Sub-groups: IVa group, Va group and VIa group of the Periodic Table, as well as of ZnO, $B_4C$, Sic, TiB and TiN.

4. A composition as claimed in claim 2, wherein said inorganic aggregate comprises alumina, zircon, mullite, silica, fused silica, magnesia, clay, silicon nitride, aluminium nitride or boron nitride, or a mixture of two or more thereof.

5. A composition as claimed in claim 2, wherein said ceramic aggregate (B) is either a glass of a high melting point or a ceramic material which is chosed from fused silica, fused alumina, mullite, fused magnesia, zircon and silicon nitride, or a pre-calcined product of a mixture of a glass powder of a high melting-point with said ceramic material.

* * * * *